US012577866B2

(12) United States Patent
Hardman et al.

(10) Patent No.: US 12,577,866 B2
(45) Date of Patent: Mar. 17, 2026

(54) PIPING ASSEMBLY FOR HYDRAULIC FRACTURING MANIFOLD

(71) Applicant: SPM Oil & Gas Inc., Fort Worth, TX (US)

(72) Inventors: Adam Stephen Hardman, Azle, TX (US); Ronald E. Arizpe, Fort Worth, TX (US)

(73) Assignee: SPM Oil & Gas Inc., Ft. Worth, TX (US)

( * ) Notice: Subject to any disclaimer, the term of this patent is extended or adjusted under 35 U.S.C. 154(b) by 17 days.

(21) Appl. No.: 18/817,335

(22) Filed: Aug. 28, 2024

(65) Prior Publication Data

US 2026/0063019 A1 Mar. 5, 2026

(51) Int. Cl.
*E21B 43/26* (2006.01)

(52) U.S. Cl.
CPC ..... *E21B 43/2607* (2020.05)

(58) Field of Classification Search
CPC ..... E21B 43/2607
See application file for complete search history.

(56) References Cited

U.S. PATENT DOCUMENTS

| | | | | |
|---|---|---|---|---|
| 10,494,878 | B2 | 12/2019 | Scott et al. | |
| 11,585,199 | B2 | 2/2023 | Sizemore et al. | |
| 11,591,888 | B2 | 2/2023 | Yeung et al. | |
| 11,608,696 | B2 | 3/2023 | Morris et al. | |
| 11,668,172 | B2 | 6/2023 | Bobadilla Larios et al. | |
| 11,846,169 | B2 | 12/2023 | Wagner et al. | |
| 12,281,557 | B1 * | 4/2025 | Warren | E21B 43/267 |
| 2015/0000766 | A1 * | 1/2015 | Arizpe | F16F 7/14 137/561 A |
| 2017/0130885 | A1 * | 5/2017 | Arizpe | F16L 55/035 |
| 2018/0223640 | A1 * | 8/2018 | Keihany | F16L 3/00 |
| 2018/0224044 | A1 * | 8/2018 | Penney | F16L 41/03 |
| 2019/0383125 | A1 * | 12/2019 | Koricanek | E21B 43/2607 |
| 2020/0109616 | A1 * | 4/2020 | Oehring | F04B 17/03 |
| 2020/0109617 | A1 * | 4/2020 | Oehring | H02B 13/00 |
| 2021/0270261 | A1 * | 9/2021 | Zhang | F04B 47/02 |
| 2022/0099227 | A1 | 3/2022 | Cherewyk | |
| 2022/0213776 | A1 * | 7/2022 | Wagner | E21B 43/2607 |

(Continued)

FOREIGN PATENT DOCUMENTS

CN 104405605 A 3/2015

*Primary Examiner* — Shane Bomar

(57) ABSTRACT

A method for performing a hydraulic fracturing operation includes providing a manifold assembly to deliver a fracturing fluid into a well bore. The manifold assembly has a low-pressure section and a high-pressure section. The high-pressure section includes first side inlets at a first side of the manifold assembly, second side inlets at a second side of the manifold assembly. The second side inlets face away from the first side inlets and the second side faces towards fracturing pumps. The method includes fluidly coupling piping assemblies to respective first side inlets. Each piping assembly, at least in part, extends laterally from the first side towards the second side and spans over the high-pressure section. The method includes fluidly coupling high-pressure discharge portions of the fracturing pumps with the piping assemblies such that, high-pressure discharge fluid flows from the fracturing pumps into the high-pressure section via the respective first side inlets.

20 Claims, 7 Drawing Sheets

(56) References Cited

U.S. PATENT DOCUMENTS

| | | | | |
|---|---|---|---|---|
| 2022/0316307 | A1* | 10/2022 | Curry | E21B 41/00 |
| 2022/0372858 | A1 | 11/2022 | Scott et al. | |
| 2023/0083234 | A1* | 3/2023 | Cook | E21B 43/2607 166/244.1 |
| 2025/0084745 | A1* | 3/2025 | Ripple | E21B 43/2607 |
| 2025/0224301 | A1* | 7/2025 | Yeung | E21B 34/08 |
| 2025/0320802 | A1* | 10/2025 | Warren | B01F 35/714 |

* cited by examiner

PIPING ASSEMBLY FOR HYDRAULIC FRACTURING MANIFOLD

TECHNICAL FIELD

The present disclosure relates to a hydraulic fracturing system having one or more manifold assemblies. More particularly, the present disclosure relates to a piping assembly that fluidly couples the high-pressure discharge of a hydraulic fracturing pump to the opposite side of a manifold assembly.

BACKGROUND

In oil or gas operations, hydraulic fracturing systems may be used to fracture a subterranean formation by conveying pressurized hydraulic fracturing fluid to a well bore traversing the subterranean formation. Hydraulic fracturing systems typically require several fluid lines, valves, pump equipment, and a manifold assembly, to deliver the fracturing fluid into the well bore. A manifold assembly generally includes a low-pressure section (e.g., one or more low-pressure passages) and a high-pressure section (e.g., one or more high-pressure passages). During operations, a fluid is generally introduced into the low-pressure section and then further pumped into the high-pressure section, e.g., to form the fracturing fluid, which may then be delivered into the well bore.

A manifold assembly applied in hydraulic fracturing operations typically includes two opposite (e.g., lateral) sides. Each side may serve as an interface for fluid transfer from a low-pressure section of the manifold assembly to a high-pressure section of the manifold assembly. In cases of 'simulfrac' operations (e.g., where multiple well bores, usually parallel and/or in close proximity to each other, may be stimulated at the same time), multiple manifold assemblies may be needed, e.g., one per well bore. However, in such cases, one lateral side of one or more of the multiple manifold assemblies typically remains unutilized owing to factors such as a proximity of the manifold assemblies to each other, spatial constraints, worksite layout, and the like.

U.S. Pat. No. 11,846,169 relates to an integrated pump and manifold assembly. The assembly includes a support structure, a manifold assembly mounted on the support structure, and one or more frac pumps. The manifold assembly includes one or more low pressure lines and a high pressure discharge line including a discharge outlet configured to fluidly couple to a wellhead. The frac pumps are each mounted on the support structure and include a frac pump inlet and a frac pump outlet. The frac pumps are configured to be in fluid communication with the low pressure lines and the high pressure discharge line. The low pressure lines, the high pressure discharge line, and the frac pumps are integrated as a single unit and mounted on the support structure.

SUMMARY OF THE INVENTION

In one aspect, the disclosure is directed to a method for performing a hydraulic fracturing operation. The method includes providing a manifold assembly configured to deliver a fracturing fluid into a well bore during the hydraulic fracturing operation. The manifold assembly includes a low-pressure section and a high-pressure section. The high-pressure section includes a plurality of first side inlets at a first side of the manifold assembly, a plurality of second side inlets at a second side of the manifold assembly, and an outlet at an end of the manifold assembly. The second side inlets face away from the first side inlets, and the second side faces towards a plurality of hydraulic fracturing pumps. The method further includes fluidly coupling one or more piping assemblies to respective inlets of the plurality of first side inlets. Each piping assembly, at least in part, extends laterally from the first side towards the second side and spans over the high-pressure section. The method also includes fluidly coupling respective high-pressure discharge portions of one or more of the hydraulic fracturing pumps with the piping assemblies such that, during the hydraulic fracturing operation, high-pressure discharge fluid is configured to flow from the one or more of the hydraulic fracturing pumps into the high-pressure section via the respective inlets of the plurality of first side inlets.

In another aspect, the disclosure relates to a hydraulic fracturing system for stimulating one or more well bores. The hydraulic fracturing system includes a manifold assembly configured to deliver a fracturing fluid into a well bore during a hydraulic fracturing operation. The manifold assembly includes a low-pressure section and a high-pressure section. The high-pressure section includes a plurality of first side inlets at a first side of the manifold assembly, a plurality of second side inlets at a second side of the manifold assembly, and an outlet at an end of the manifold assembly. The second side inlets face away from the first side inlets. The hydraulic fracturing system includes a plurality of hydraulic fracturing pumps arranged towards the second side of the manifold assembly. Further, the hydraulic fracturing system includes one or more piping assemblies fluidly coupled to respective inlets of the plurality of first side inlets. Each piping assembly, at least in part, extends laterally from the first side towards the second side, spanning over the low-pressure section and the high-pressure section. The hydraulic fracturing system also includes a plurality of fluid lines to fluidly couple respective high-pressure discharge portions of one or more of the hydraulic fracturing pumps with the piping assemblies such that, during the hydraulic fracturing operation, high-pressure discharge fluid flows from the hydraulic fracturing pumps into the high-pressure section via the respective inlets of the plurality of first side inlets.

In yet another aspect, the disclosure relates to a system to deliver a frac fluid from a low-pressure section of a manifold assembly to a high-pressure section of the manifold assembly. The system includes one or more piping assemblies configured to be fluidly coupled to respective inlets of a plurality of first side inlets of the high-pressure section. The plurality of first side inlets are located at a first side of the manifold assembly. Each piping assembly defines an opening configured to face away from the first side. The second side is opposite to the first side. Each piping assembly includes a plurality of pipe segments coupled together in a series to define a flow path from a respective first side inlet to the opening. Further, each piping assembly includes a mounting block assembly to support the piping assembly immovably with respect to the high-pressure section and the low-pressure section.

DETAILED DESCRIPTION

Reference will now be made in detail to specific embodiments or features, examples of which are illustrated in the accompanying drawings. Generally, corresponding reference numbers may be used throughout the drawings to refer to the same or corresponding parts, e.g., 1, 1', 1", 101 and 201 could refer to one or more comparable components used in the same and/or different depicted embodiments.

Figure 1:
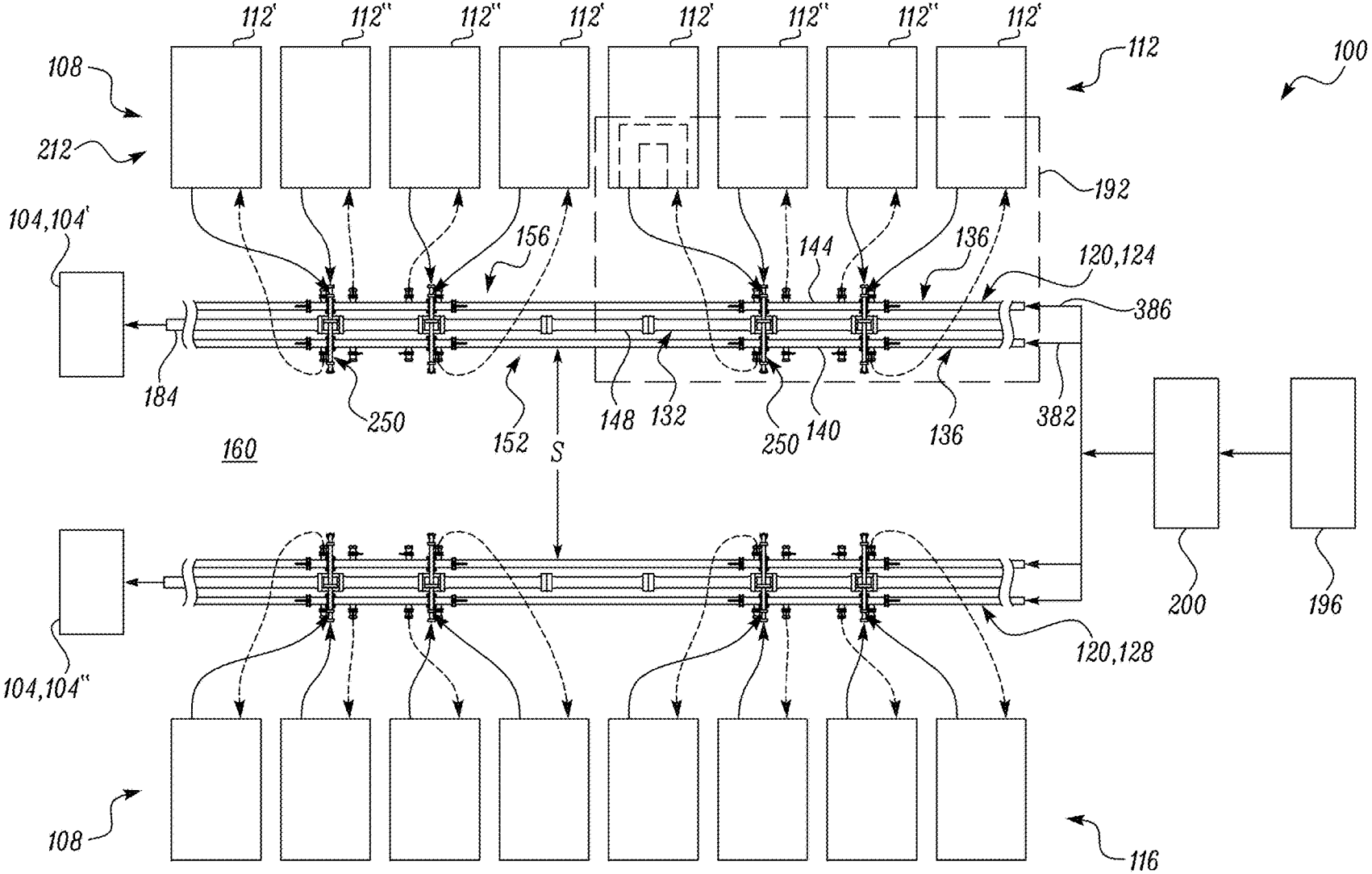
FIG. 1 is a schematic view of an exemplary hydraulic fracturing system having one or more manifold assemblies, in accordance with an embodiment of the present disclosure.
Figure 2:
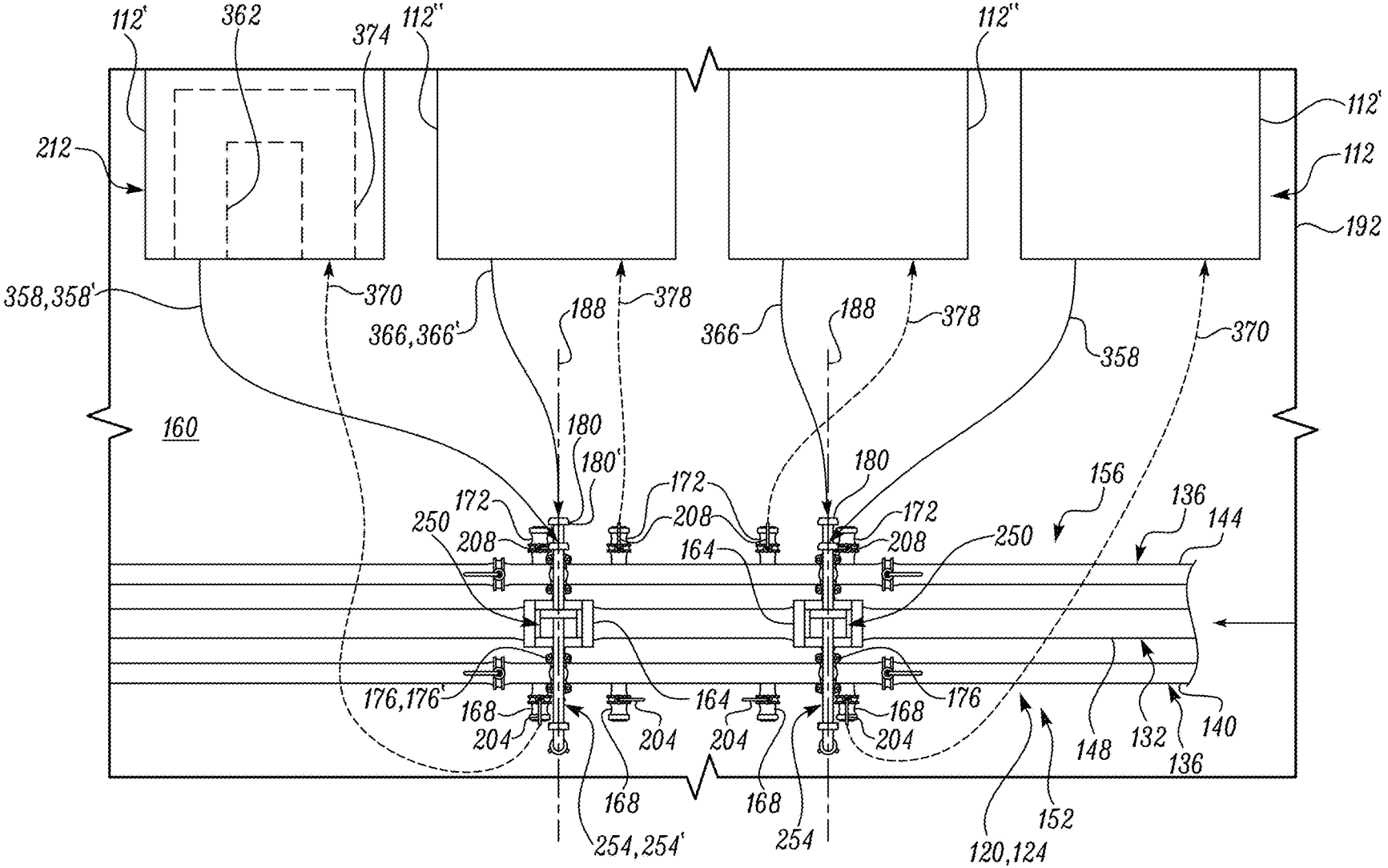
FIG. 2 is a close-up view of a portion of the hydraulic fracturing system of FIG. 1, in accordance with an embodiment of the present disclosure.

Referring to FIGS. 1 and 2, a hydraulic fracturing system 100 is described. The hydraulic fracturing system 100 may be used to perform a hydraulic fracturing operation, in which a fracturing fluid may be supplied into a subterranean formation by stimulating one or more well bores 104 (e.g., see first well bore 104' and a second well bore 104") to fracture one or more parts of the subterranean formation. In so doing, cracks may be formed in those parts of the subterranean formation and accordingly oil and/or gas may be extracted therefrom. Although aspects of the present disclosure relate to the hydraulic fracturing system 100, it will be appreciated that the embodiments described herein are not limited to the hydraulic fracturing system 100 alone. Rather, said embodiments may be applied to any other system or process in which a pressurized fluid may be delivered into a sub-surface location or a subterranean formation, e.g., through one or more well bores.

With continued reference to FIGS. 1 and 2, the hydraulic fracturing system 100 may include hydraulic fracturing pumps 108. The hydraulic fracturing pumps 108 may include a primary set of hydraulic fracturing pumps 112 and a secondary set of hydraulic fracturing pumps 116, as shown. Further, the hydraulic fracturing system 100 may include one or more manifold assemblies 120, e.g., a first manifold assembly 124 and a second manifold assembly 128. The manifold assemblies 120 may be applied to work in concert with the hydraulic fracturing pumps 108 to help convey or deliver a pressurized fracturing fluid, e.g., supplied or pressurized by the hydraulic fracturing pumps 108, into the well bores 104 and/or to parts of the subterranean formation. As an example, the primary set of hydraulic fracturing pumps 112 may be associated with the first manifold assembly 124 and the secondary set of hydraulic fracturing pumps 116 may be associated with the second manifold assembly 128.

In some embodiments, the first manifold assembly 124 may be positioned relatively close to the second manifold assembly 128. The expression 'relatively close' may mean that a space, S, defined between the first manifold assembly 124 and the second manifold assembly 128 may be limited or insufficient for accommodating any of the hydraulic fracturing pumps 108 from any of the primary set of hydraulic fracturing pumps 112 and the secondary set of hydraulic fracturing pumps 116.

Further, details in the present disclosure may be directed mainly towards the first manifold assembly 124. Discussions corresponding to first manifold assembly 124 may be applied to the second manifold assembly 128, as well. Moreover, discussions below are also mainly directed towards the primary set of hydraulic fracturing pumps 112, and its arrangement and working with the first manifold assembly 124. Such discussions may be suitably applied to the secondary set of hydraulic fracturing pumps 116, and its arrangement and working with the second manifold assembly 128, as well. For ease, the first manifold assembly 124 may be simply referred to as a manifold assembly 124 and the primary set of hydraulic fracturing pumps 112 may be simply referred to as hydraulic fracturing pumps 112.

The manifold assembly 124 may include or define a (relatively) high-pressure section 132 and a (relatively) low-pressure section 136 each of which may receive a fluid for performance of the hydraulic fracturing operation. Although not limited, the low-pressure section 136 may include a first passage 140 and a second passage 144, whereas the high-pressure section 132 may include one or more pressure channels (e.g., see pressure channel or a third passage 148). Example pressures (e.g., fluid pressures) that may be applicable in the low-pressure section 136 (or in the first passage 140 and the second passage 144) may be below 8,000 pounds per square inch (psi), while example pressures (e.g., fluid pressures) that may be applicable in the high-pressure section 132 (or in the pressure channel or the third passage 148) may be above 15,000 psi. It will be appreciated that these values are provided for illustrative purposes only and can include other values—such values may depend upon the type and/or area of application of the manifold assembly 124. The manifold assembly 124 may define a first side 152 and a second side 156. The second side 156 may be opposite to the first side 152.

The first passage 140 may be positioned towards the first side 152 and the second passage 144 may be positioned towards the second side 156. Although not limited, the first passage 140, the second passage 144, and the third passage 148 may be in the form of longitudinal channels or tubes. In some embodiments, the second passage 144 may be parallel to the first passage 140. In some embodiments, at least one of or both of the first passage 140 and the second passage 144 may be parallel to the third passage 148. Furthermore, in some embodiments, both the first passage 140 and the second passage 144 may be mounted onto a series of skids and/or onto one or more trailers (not shown), which may serve as a base for the manifold assembly 124 to be deployed over a surface of a worksite 160 from where the hydraulic fracturing operation may be executed. In some embodiments, the third passage 148 includes modules 164 arranged along a length of the third passage.

According to an aspect of the present disclosure, the first passage 140 may include multiple first side outlets 168 and the second passage 144 may include multiple second side outlets 172. The first side outlets 168 may be located at or provided towards the first side 152 of the manifold assembly 124. The second side outlets 172 may be located at or provided towards the second side 156 of the manifold assembly 124. The first side outlets 168 may be arranged in series along a length of the first passage 140, and, similarly, the second side outlets 172 may be arranged in series along a length of the second passage 144. Also, the high-pressure section 132 or the third passage 148 may include multiple side inlets, e.g., first side inlets 176 (also see FIG. 3) provided at or towards the first side 152 and second side inlets 180 provided at or towards the second side 156, as shown. Each of the first side inlets 176 and the second side inlets 180 may be provided in series along a length of the third passage 148.

Although not limited, the second side inlets 180 may face away from the first side inlets 176. Also, the second side 156 may face towards the hydraulic fracturing pumps 112. In some embodiments, the third passage 148 includes an outlet 184 (see FIG. 1) at one end of the manifold assembly 124 through which the pressurized fracturing fluid may exit the manifold assembly 124 and enter into the first well bore 104'. Although not limited, the first side inlets 176 and the second side inlets 180 may be correspondingly mounted onto the modules 164 of the high-pressure section 132 or the third passage 148 such that each module 164 may include one first side inlet 176 and one second side inlet 180 both facing away or opposite to each other. In some embodiments, for each of the modules 164, the corresponding first side inlet 176 and the corresponding second side inlet 180 may extend co-axially with each other and linearly along a first axis 188 (also see FIG. 3). As an example, the first axis 188 may pass laterally across the high-pressure section 132 and the low-pressure section 136. Although not limited, such a configuration may be applicable for each of the modules 164 of the high-pressure section 132.

In some embodiments, the manifold assembly 124 may receive one or more fluids that can be pressurized and delivered into the first well bore 104' for performing the hydraulic fracturing operation. As an example, further discussions below will include an exemplary manner of functioning/working of the manifold assembly 124 by way using two exemplary fluids, namely a first fluid and a second fluid. It will be appreciated that such description is provided for exemplary purposes alone and those in the art can contemplate variations in the same. For example, the manifold assembly 124 may utilize a single fluid for pressurization and delivery into the first well bore 104', or, alternatively, more than two fluids for pressurization and delivery into the first well bore 104', as well. Moreover, further discussions below may be mostly directed towards a section 192 of the manifold assembly 124 (and/or of the hydraulic fracturing system 100), as shown in FIGS. 1 and 2, and those skilled in the art may apply such disclosure to other sections of the manifold assembly 124 (and/or of the hydraulic fracturing system 100).

The first fluid may be different from the second fluid. For example, the first fluid may be a clean fluid while the second fluid may be a dirty fluid or may include a slurry. As an example, both the first fluid and the second fluid may be sourced from one or more reservoirs (e.g., see reservoir 196 in FIG. 1) of the hydraulic fracturing system 100. In some embodiments, the first fluid or the clean fluid may be directly supplied from the reservoir 196, while the second fluid may be formed by passing a fluid (e.g., a clean fluid such as the first fluid itself from the reservoir 196) and then mixing and blending said fluid with various materials in a blender 200 (see FIG. 1) of the hydraulic fracturing system 100. The various materials may include proppant, sand, and/or other additives, now known or in the future developed. By way of such mixing, the second fluid and/or the slurry may be formed, e.g., in the blender 200. In some embodiments, the receipt of the first fluid and the second fluid into the manifold assembly 124 may be switched or interchanged, for example, in some alternative embodiments, the first fluid may be received into the second passage 144 and the second fluid may be received into the first passage 140.

In some embodiments, each of the first side outlets 168 may include a first valve 204 such that a flow of the first fluid through each of the first side outlets 168 may be regulated. Similarly, each of the second side outlets 172 may include a second valve 208 such that a flow of the second fluid through each of the second side outlets 172 may be regulated. Also, in some embodiments, each of the first side inlets 176 may include a third valve (not shown) to regulate the flow of pressurized first fluid into the third passage 148 or into the high-pressure section 132. Similarly, each of the second side inlets 180 may include a fourth valve (not shown) to regulate the flow of pressurized second fluid into the third passage 148 or into the high-pressure section 132.

The hydraulic fracturing pumps 112 may be applied to generate suction to receive the first fluid and the second fluid from the low-pressure section 136 of the manifold assembly 124, pressurize the first fluid and the second fluid, and supply a pressurized first fluid and a pressurized second fluid into the high-pressure section 132 of the manifold assembly 124. In this regard, and although not limited, the hydraulic fracturing pumps 112 may be arranged towards the second side 156 of the manifold assembly 124. In some embodiments, the hydraulic fracturing pumps 112 may be arranged according to an array 212, e.g., a straight array, which may extend along the second side 156 along a length of the manifold assembly 124, as shown in FIG. 1.

Further, the hydraulic fracturing pumps 112 (e.g., the primary set of the hydraulic fracturing pumps 112) may include first hydraulic fracturing pumps 112' and second hydraulic fracturing pumps 112". As shown in FIG. 1, the first hydraulic fracturing pumps 112' and the second hydraulic fracturing pumps 112" may be set out according to an example order in the array 212. With regard to the example order in the array 212, when viewing FIGS. 1 and 2 from right to left, a first hydraulic fracturing pump 112' may be positioned at the start of the array 212, the first hydraulic fracturing pump 112' may be followed by two second hydraulic fracturing pumps 112", which may be in turn further followed by another first hydraulic fracturing pump 112'. Although not limited, such an order may be applicable throughout the array 212 of the hydraulic fracturing pumps 112. The array 212 of the hydraulic fracturing pumps 112, and the order described above for the same, is exemplary and those skilled in the art may contemplate variations in such an array and/or in the order of placement of one or more of the hydraulic fracturing pumps 112.

Figure 3:
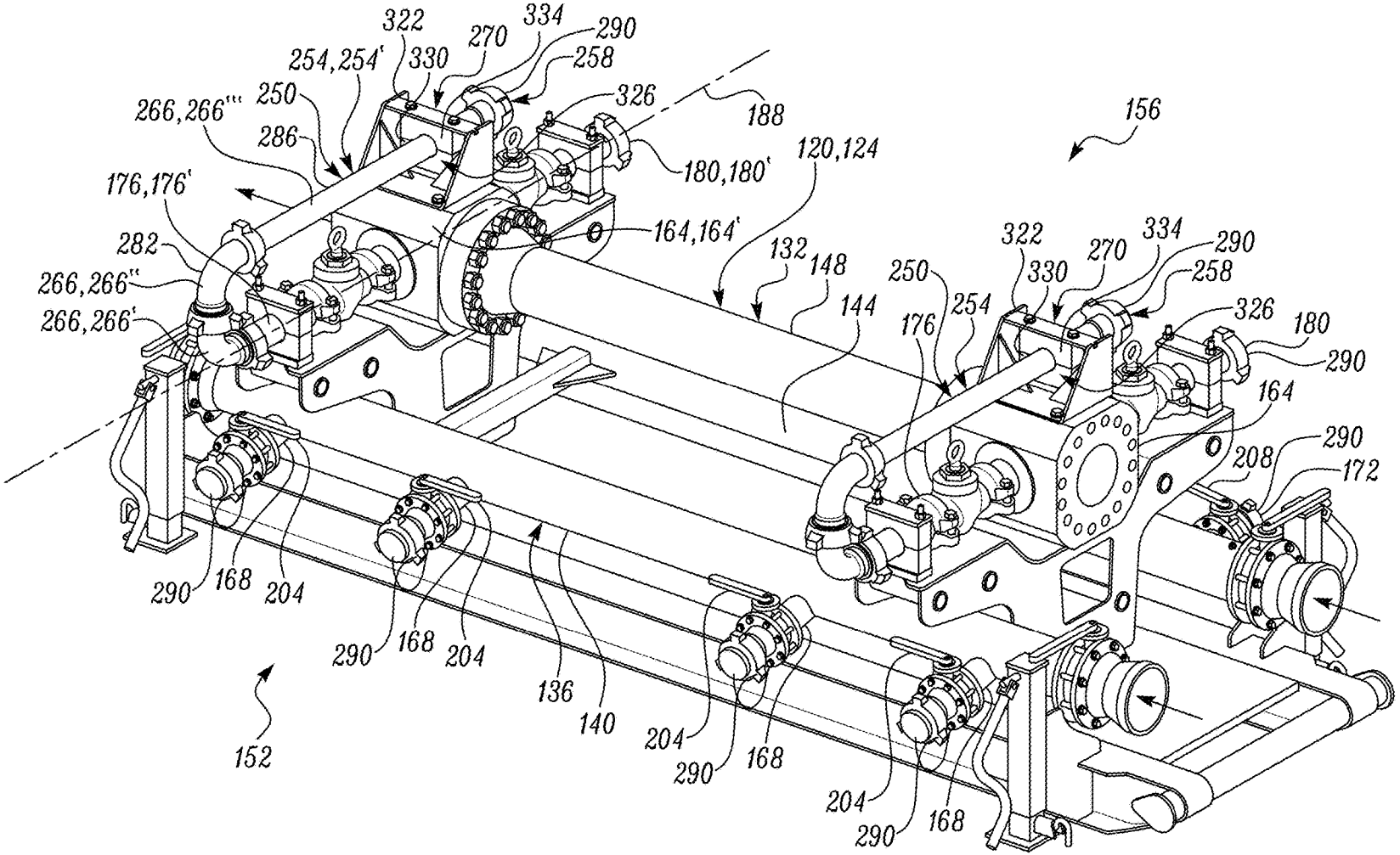
FIG. 3 is a perspective view of a portion of the hydraulic fracturing system illustrating one or more piping assemblies according to a first embodiment, in accordance with an embodiment of the present disclosure.
Figure 4:
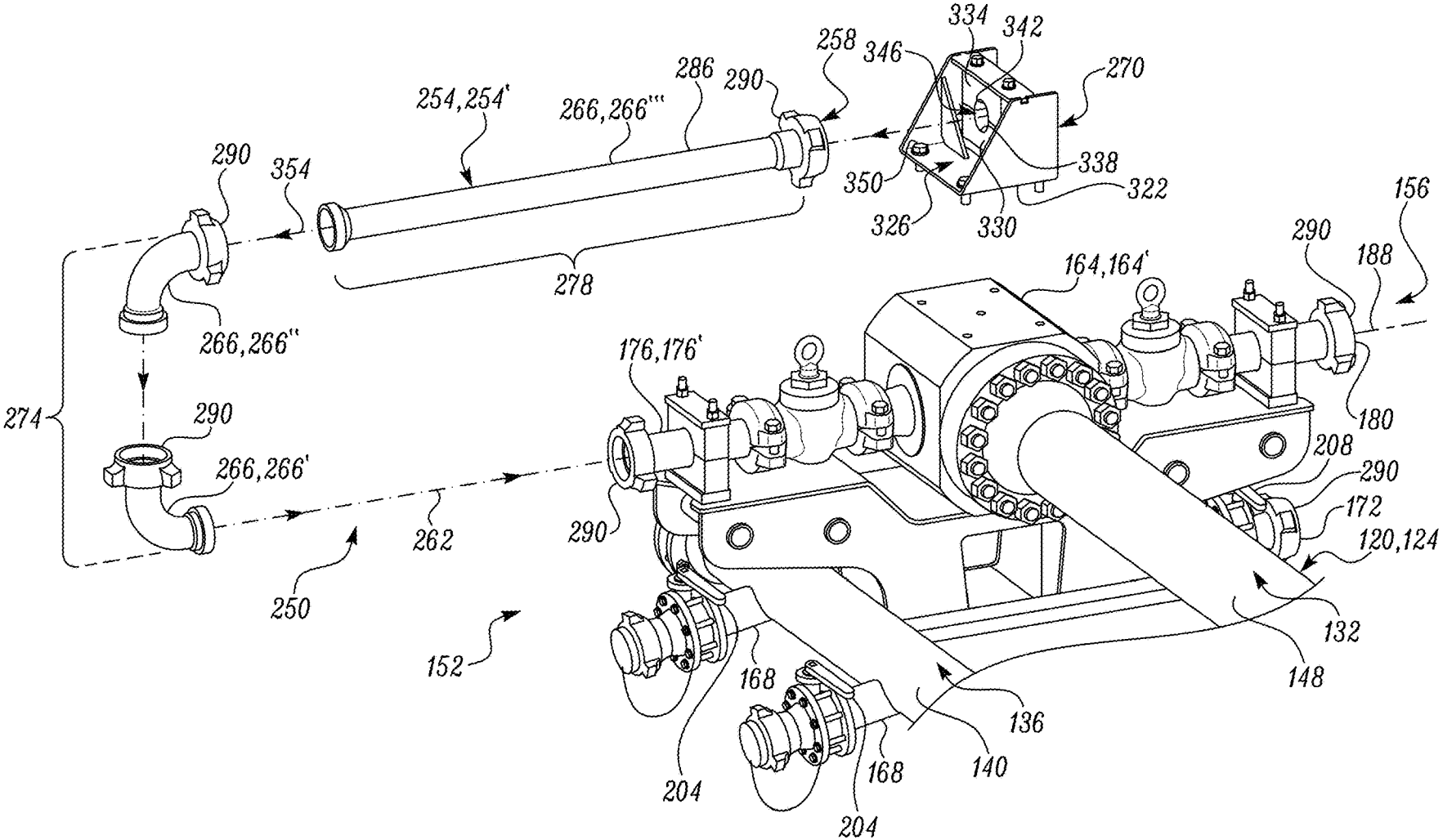
FIG. 4 is an exploded view of one of the piping assemblies illustrated in FIG. 3 according to the first embodiment, in accordance with an embodiment of the present disclosure.

Referring to FIGS. 3 and 4, and also in conjunction with FIGS. 1 and 2, the hydraulic fracturing system 100 includes a system 250, which at least in part, delivers a frac fluid (e.g., the pressurized first fluid) from the low-pressure section 136 (e.g., from the first passage 140) of the manifold assembly 124 to the high-pressure section 132 (e.g., the third passage 148) of the manifold assembly 124. The system 250 includes one or more piping assemblies—see piping assemblies 254. The piping assemblies 254 may be configured to be fluidly coupled to respective first side inlets 176 of the high-pressure section 132. As an example, the piping assembly 254' has been discussed, and discussions corresponding to the piping assembly 254' may be suitably applied to all other piping assemblies 254 of the system 250.

The piping assembly 254' may be fluidly coupled to the first side inlet 176'. The piping assembly 254' may define an opening 258. The opening 258 may face away from the first side 152. In some embodiments, the opening 258 may be directed towards the second side 156 and/or towards the hydraulic fracturing pumps 112. Further, the piping assembly 254' may define a flow path 262 (see FIG. 4) extending from the first side inlet 176' to the opening 258, with an exemplary direction of the flow path 262, e.g., of the first fluid, being defined from the opening 258 to the first side inlet 176', as shown in FIG. 4). The piping assembly 254' may include multiple pipe segments 266 and a mounting block assembly 270.

The pipe segments 266 may be coupled together in a series to define a first part 274 and a second part 278 (see FIG. 4), with the flow path 262 extending therethrough. As shown, the first part 274 may extend from the first side inlet 176' and the second part 278 may extend from the first part 274 to the opening 258. The piping assembly 254' may exemplarily include three (3) pipe segments 266, namely, a first pipe segment 266', a second pipe segment 266", and a third pipe segment 266'''. The first pipe segment 266' and the second pipe segment 266" may (e.g., collectively) form the first part 274 while the third pipe segment 266''' may (e.g., independently) form the second part 278. At least one of the first part 274 and the second part 278 includes a curved portion. For example, the first part 274, formed by the first pipe segment 266' and the second pipe segment 266", may define a curved portion 282 (see FIG. 3). To this end, both the first pipe segment 266' and the second pipe segment 266" may define an arcuate profile such that when they may be brought together, they may collectively contribute and define a shape of the curved portion 282. According to some embodiments, the second part 278 or the third pipe segment 266''' may include a straight portion 286.

Figure 7:
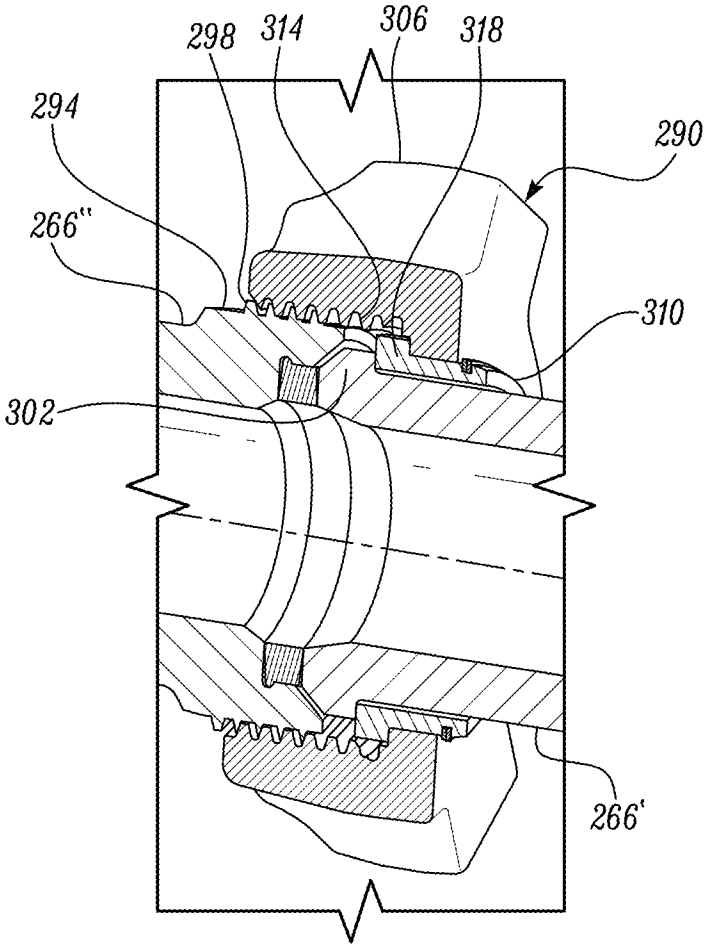
FIG. 7 is a cross-sectional view of a coupler used for coupling one or more pipe segments of a piping assembly either with each other or with an inlet of a manifold assembly of the hydraulic fracturing system, in accordance with an embodiment of the present disclosure.

In some embodiments, the piping assembly 254' includes a coupler 290 (see also FIG. 7). The coupler 290 may be configured to couple (e.g., fluidly couple) one pipe segment (e.g., the first pipe segment 266') to another pipe segment (e.g., the second pipe segment 266"). In this regard, the second pipe segment 266" may include a collar portion 294 with outer threads 298 and the first pipe segment 266' may include a step portion 302. Further, in this regard, the coupler 290 may include a rotatable sleeve 306 and a locking sleeve 310. The rotatable sleeve 306 may define internal threads 314. For coupling the first pipe segment 266' to the second pipe segment 266", the locking sleeve 310 may be inserted into the rotatable sleeve 306 and the first pipe segment 266' may be in turn inserted into the locking sleeve 310 such that the locking sleeve 310 may abut against the step portion 302. Further, the rotatable sleeve 306 may be retained against a retention stopper 318 of the locking sleeve 310 and encompassed over the collar portion 294 such that the outer threads 298 mate with the internal threads 314. With such mating, when the rotatable sleeve 306 is rotated against the collar portion 294, the rotatable sleeve 306 may bring the collar portion 294 closer to the step portion 302, tightening them and in turn causing the first pipe segment 266' to be engaged and coupled (e.g., fluidly) with the second pipe segment 266", forming at least a portion of the flow path 262 therethrough. It may be noted that similar manner of coupling, e.g., by way of the other couplers 290, similar to the coupler 290, may be used to couple (e.g., fluidly couple) various parts or segments of the piping assembly 254' to each other and/or to couple the piping assembly 254' to the first side inlet 176'.

Referring back to FIG. 4, the mounting block assembly 270 may be used to support the piping assembly 254' immovably with respect to the high-pressure section 132 and the low-pressure section 136. The mounting block assembly 270 may include a template 322 with a cavity 326, a first bracket 330, and a second bracket 334. The first bracket 330 may define a first cutout 338 and the second bracket 334 may define a second cutout 342. In an assembly of the mounting block assembly 270, the first bracket 330 and the second bracket 334 may be positioned into the cavity 326 defined by the template 322 and the template 322 may be in turn mounted onto the module 164', with the second part 278 of the piping assembly 254' passing via a through-slot 346 formed by bringing the first cutout 338 and the second cutout 342 together in the cavity 326.

As part of an exemplary assembly process, and/or to support the piping assembly 254' immovably with respect to the high-pressure section 132 (and also the low-pressure section 136), the template 322 may be first fastened (e.g., using fasteners 350) onto the module 164' of the third passage 148 or the high-pressure section 132. Thereafter, the first bracket 330 may be placed into the cavity 326 of the template 322 which may be followed by the placement of the second part 278 of the piping assembly 254' into the first cutout 338 defined by the first bracket 330. Once the second part 278 is positioned into the first cutout 338, the second bracket 334 may be brought into abutment with the first bracket 330 in a manner that the second cutout 342 falls in line or registers with the first cutout 338 and that both the first cutout 338 and the second cutout 342 forms the through-slot 346 and envelops the second part 278. In some embodiments, the second part 278 may extend linearly along a second axis 354 parallel to the first axis 188.

Both the first bracket 330 and the second bracket 334 may be coupled (e.g., threadably coupled) to the template 322 and in turn to the module 164' such that the piping assembly 254' may be immovably retained with respect to the module 164'. Moreover, when the piping assembly 254' is assembled with the module 164', the piping assembly 254', at least in part, extends laterally from the first side 152 towards the second side 156 and spans over the high-pressure section 132 and the low-pressure section 136.

In some embodiments, the first bracket 330 may be replaceable with one or more other first brackets, such that differently sized first cutouts of those other first brackets may accommodate differently sized second parts (e.g., see the second part 278) of other piping assemblies. Similarly, in some embodiments, the second bracket 334 may be replaceable with one or more other second brackets, such that differently sized second cutouts of those other second brackets may accommodate the differently sized second parts (e.g., see the second part 278) of other piping assemblies. Further, the circular cross-sections of the second part 278 and/or the through-slot 346, as suggested in one or more of the FIGS. 3 through 7, is purely an example, and said cross-sections may take any suitable shape or profile.

In some embodiments, the hydraulic fracturing system 100 includes first fluid lines 358, e.g., see first fluid line 358'. For simplicity and ease in understanding, the first fluid lines 358 are illustrated as solid curves. Those in the art may contemplate the first fluid lines 358 to include hoses, and/or the like connection conduits. As an example, the first fluid line 358' may be applied to fluidly couple high-pressure discharge portions 362 (only one marked in FIG. 2) of one of the first hydraulic fracturing pumps 112' with the piping assembly 254' (e.g., the opening 258 of the piping assembly 254'). The coupling may be attained by using a coupler, such as the coupler 290. In so doing, during the hydraulic fracturing operation, high-pressure discharge fluid may flow from the first hydraulic fracturing pumps 112' into the high-pressure section 132 via the first fluid lines 358, the piping assemblies 254, and the first side inlets 176.

In some embodiments, the hydraulic fracturing system 100 includes second fluid lines 366, e.g., see second fluid line 366'. For simplicity and ease in understanding, the second fluid lines 366 are illustrated as solid curves. Those in the art may contemplate the second fluid lines 366 to include hoses, and/or the like connection conduits. As an example, the second fluid line 366' may be applied to fluidly couple a respective high-pressure discharge portion 362 of a corresponding second hydraulic fracturing pumps 112" with the high-pressure section 132 via respective second side inlets 180 (e.g., see second side inlet 180') (FIG. 2). In so doing, during the hydraulic fracturing operation, high-pressure discharge fluid may flow from the second hydraulic fracturing pumps 112" into the high-pressure section 132 via the respective second side inlets 180.

In some embodiments, the hydraulic fracturing system 100 includes first low-pressure fluid lines 370 (exemplarily illustrated as broken curves in FIG. 2). The first low-pressure fluid lines 370 may correspondingly fluidly couple low-pressure receiving portions 374 (only one marked in FIG. 2) of the first hydraulic fracturing pumps 112' with first side outlets 168 of the low-pressure section 136 located towards the first side 152 of the manifold assembly 124 such that the first fluid is received into the first hydraulic fracturing pumps 112' through the first side outlets 168 of the low-pressure section 136. In some embodiments, the hydraulic fracturing system 100 includes second low-pressure fluid lines 378 (also exemplarily illustrated as broken curves in FIG. 2). The second low-pressure fluid lines 378 may correspondingly fluidly couple low-pressure receiving portions 374 (only one marked in FIG. 2) of the second hydraulic fracturing pumps 112" with second side outlets 172 of the low-pressure section 136 located towards the second side 156 of the manifold assembly 124 such that the second fluid is received into the second hydraulic fracturing pumps 112" through the second side outlets 172 of the low-pressure section 136.

Figure 5:
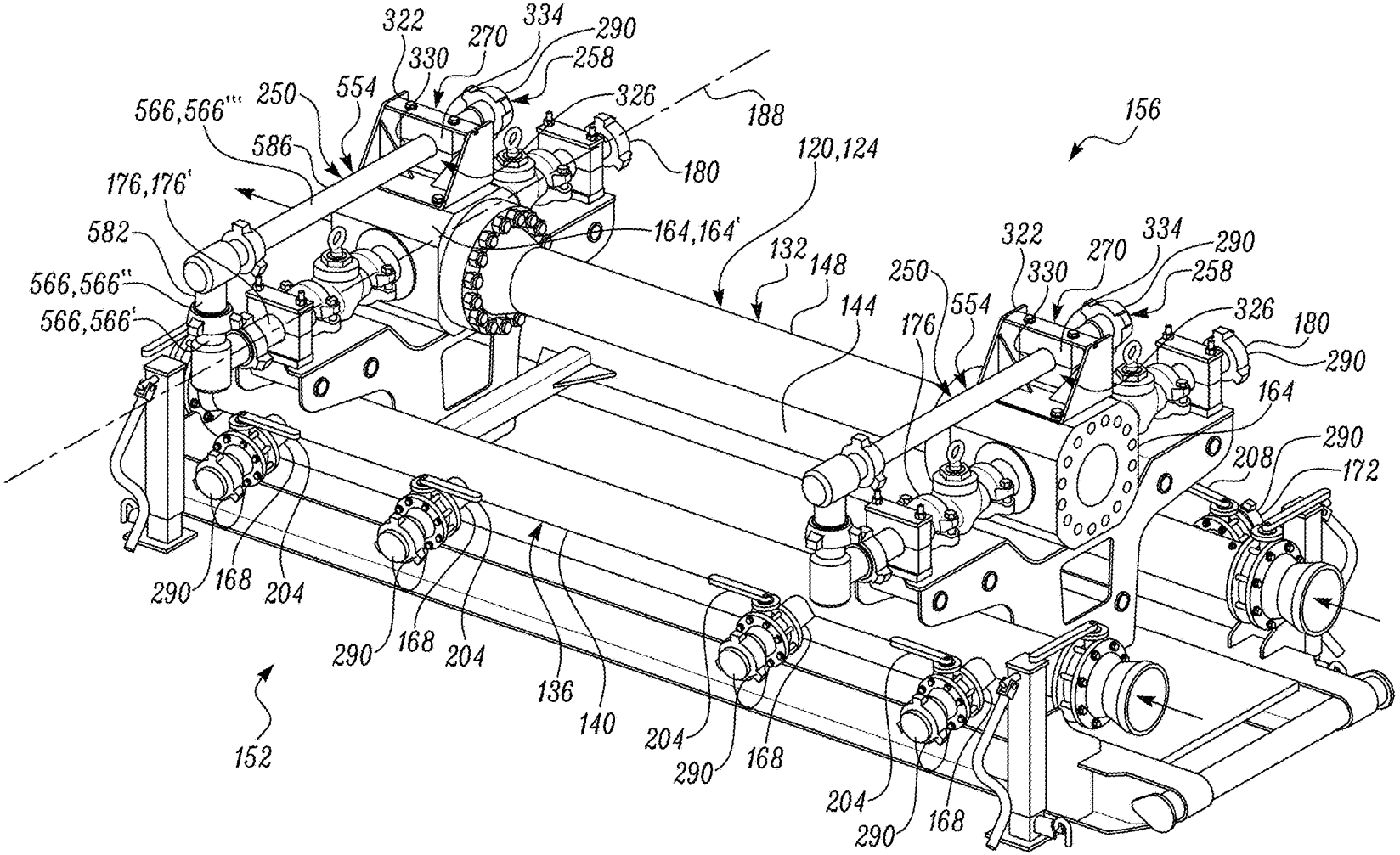
FIG. 5 is a perspective view of a portion of the hydraulic fracturing system illustrating one or more piping assemblies according to a second embodiment, in accordance with an embodiment of the present disclosure.
Figure 6:
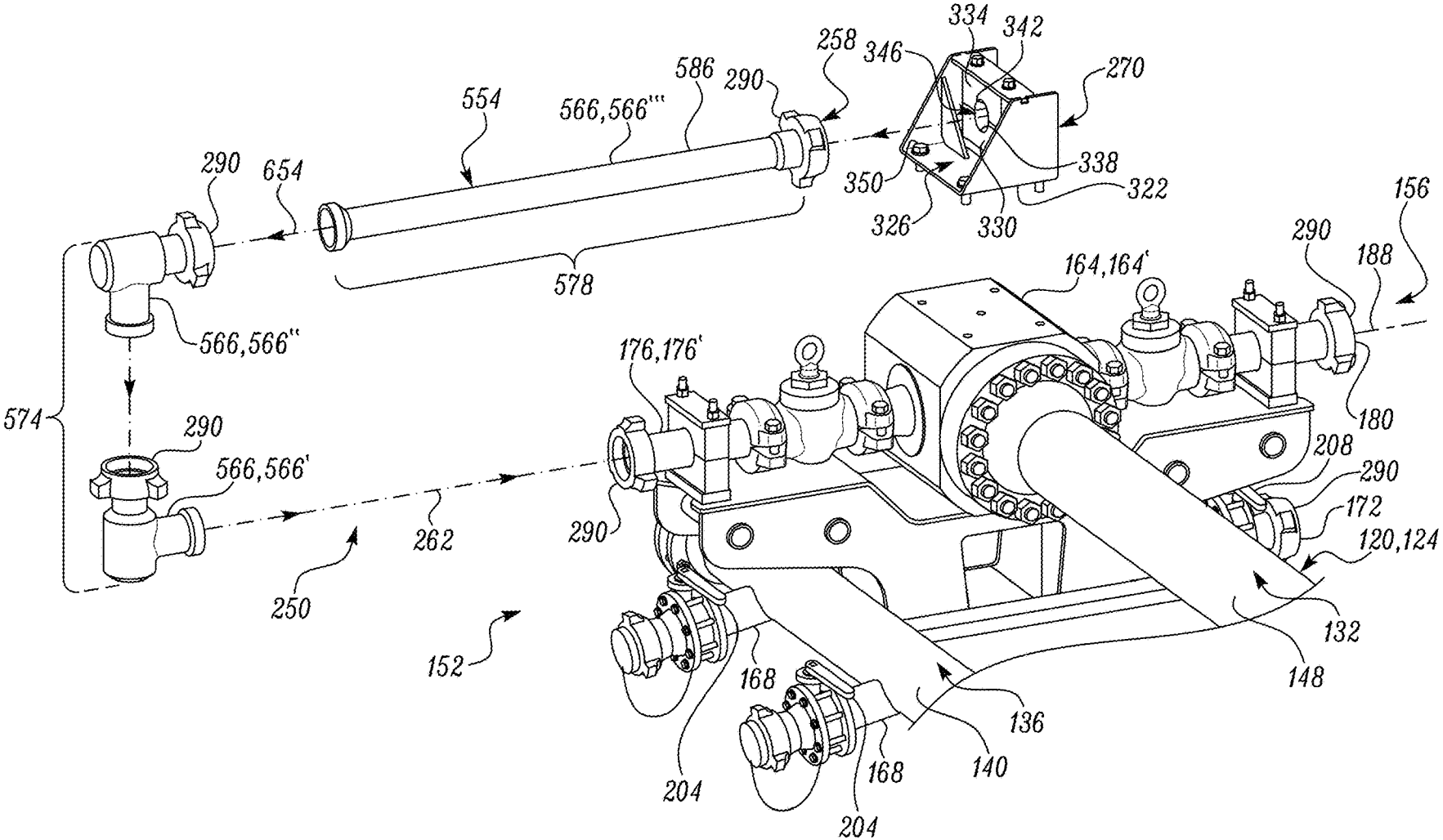
FIG. 6 is an exploded view of one of the piping assemblies illustrated in FIG. 5 according to the second embodiment, in accordance with an embodiment of the present disclosure.

Referring to FIGS. 5 and 6, a piping assembly 554, according to another embodiment of the present disclosure, is described. The piping assembly 554 is similar to the piping assembly 254, with the exception that a first part 574 of the piping assembly 554 includes a straight portion 582 (see FIG. 5) conversely to the curved portion 282 of first part 274 of the piping assembly 254. Wherever possible, same or similar reference numerals have been used for correspondence or comparison with the piping assembly 254. As with the piping assembly 254, the piping assembly 554 may exemplarily include three (3) pipe segments 566, namely, a first pipe segment 566', a second pipe segment 566", and a third pipe segment 566'''. The first pipe segment 566' and the second pipe segment 566" may (e.g., collectively) form the first part 574 while the third pipe segment 566''' may (e.g., independently) form a second part 578 (similarly to the second part 278). At least one or both of the first part 574 and the second part 578 includes a straight portion. For example, the first part 574, formed by the first pipe segment 566' and the second pipe segment 566", may include the straight portion 582 (see FIG. 5). To this end, both the first pipe segment 566' and the second pipe segment 566" may define a linear profile such that when they may be brought together, they may collectively contribute and define a shape of the straight portion 582. According to some embodiments, the second part 578 or the third pipe segment 566''' may include a straight portion 586, as well, and thus may extend linearly along a second axis 654 (see FIG. 6) parallel to the first axis 188.

The straight portion 582 in the piping assembly 554 helps make the piping assembly 554 relatively more space efficient, thus helping with shipping and transportation of the piping assembly 554. The curved portion 282 in the piping assembly 254 reduces interruptions in the flow path 262, in turn helping to ease out fluid passage to the high-pressure section 132 when using the piping assembly 254. Moreover, depending upon an area of application of the hydraulic fracturing system 100, the piping assembly 554 may be used alone or in conjunction with the piping assembly 254.

INDUSTRIAL APPLICABILITY

An exemplary method of performing the hydraulic fracturing operation is described. The method will be described with reference to FIGS. 1 and 2, and also in conjunction with FIGS. 3 through 6. As part of the method, an operator may provide the manifold assembly 124 (e.g., at the worksite 160) such that the manifold assembly 124 may deliver the fracturing fluid into the first well bore 104' during the hydraulic fracturing operation. Further, the operator may fluidly couple the piping assemblies 254 respectively to the first side inlets 176 (e.g., see fluid coupling of piping assembly 254' to the first side inlet 176' in FIGS. 2 through 4). As an example, for the piping assembly 254', the coupler 290 may be applied to couple an end of the first part 274 of the piping assembly 254' to an end of the first side inlet 176'. Similar couplers may be used to fluidly couple the other piping assemblies 254 respectively to the other first side inlets 176. Once such coupling is attained, each of the piping assemblies 254' may extend laterally from the first side 152 towards the second side 156, spanning over the high-pressure section and the low-pressure section of the manifold assembly. In so doing, the openings 258 defined by the piping assemblies 254 may be directed toward the second side 156 and/or towards the hydraulic fracturing pumps 112. In some embodiments, fluidly coupling the piping assemblies 254 to the first side inlets 176 includes coupling the mounting block assembly 270 associated with each piping assembly 254 onto a respective module 164 of the high-pressure section 132 that includes a corresponding first side inlet (e.g., see first side inlet 176') and a corresponding second side inlet (e.g., see second side inlet 180') (see FIGS. 2 and 3).

Next, the operator may use the first fluid lines 358 to fluidly couple respective high-pressure discharge portions 362 of the hydraulic fracturing pumps 112 (e.g., the first hydraulic fracturing pumps 112') with the piping assemblies 254 (or with the openings 258 defined by the piping assemblies 254). Also, the operator may use the second fluid lines 366 to fluidly couple high-pressure discharge portions 362 of the hydraulic fracturing pumps 112 (e.g., second hydraulic fracturing pumps 112") with the high-pressure section 132 respectively via the second side inlets 180.

Furthermore, the operator may also use the first low-pressure fluid lines 370 to correspondingly fluidly couple low-pressure receiving portions 374 of the first hydraulic fracturing pumps 112' correspondingly with first side outlets 168 of the low-pressure section 136 such that fluid (e.g., first fluid) is received into the first hydraulic fracturing pumps 112' through the first side outlets 168 of the low-pressure section 136. Similarly, the operator may also use the second low-pressure fluid lines 378 to correspondingly fluidly couple low-pressure receiving portions 374 of the second hydraulic fracturing pumps 112" correspondingly with second side outlets 172 of the low-pressure section 136 such that fluid (e.g., second fluid) is received into the second hydraulic fracturing pumps 112" through the second side outlets 172 of the low-pressure section 136.

During an operation of the hydraulic fracturing system 100, the first fluid may be supplied into the first passage 140 of the low-pressure section 136 of the manifold assembly 124, e.g., through a first inlet end 382 (see FIG. 1) of the first passage 140. Also, the second fluid may be supplied into the second passage 144 of the low-pressure section 136 of the manifold assembly 124, e.g., through a second inlet end 386 (see FIG. 1) of the second passage 144. Both the first fluid and the second fluid may be further drawn into the hydraulic fracturing pumps 112 or into low-pressure receiving portions 374 of the hydraulic fracturing pumps 112 (e.g., owing to a suction generated by the hydraulic fracturing pumps 112).

The first fluid (e.g., the clean fluid) may be drawn into low-pressure receiving portions 374 of the first hydraulic fracturing pumps 112' by way of the first side outlets 168 and the first low-pressure fluid lines 370. The second fluid (e.g., the slurry) may be drawn into low-pressure receiving portions 374 of the second hydraulic fracturing pumps 112" by way of the second side outlets 172 and the second low-pressure fluid lines 378. The first hydraulic fracturing pumps 112' and the second hydraulic fracturing pumps 112" may pressurize the inflowing first fluid and the inflowing second fluid and may accordingly pump and/or supply (e.g., from high-pressure discharge portions 362 of the hydraulic fracturing pumps 112) the pressurized first fluid and the pressurized second fluid into the high-pressure section 132 of the manifold assembly 124.

During such supply, while the pressurized second fluid may flow into the high-pressure section 132 or the third passage 148 through the second fluid lines 366, a flow of the pressurized first fluid into the high-pressure section 132 or the third passage 148 may be attained through the first fluid lines 358 and through the piping assemblies 254. With space, S, lacking sufficient real estate for the first hydraulic fracturing pumps 112, the piping assemblies 254 (e.g., in conjunction with the first fluid lines 358) help the operator achieve fluid transfer between the first passage 140 and the third passage 148. Such fluid transfer is achieved without having to station the first hydraulic fracturing pumps 112' towards the first side 152 or accommodate the first hydraulic fracturing pumps 112' in some way within the space, S. In effect, both sides (e.g., the first side 152 and the second side 156) of the manifold assembly 124 may be utilized for the hydraulic fracturing operation, in spite of the limitation yielded by way of the insufficient space, S, defined between the first manifold assembly 124 and the second manifold assembly 128. Such a configuration of the hydraulic fracturing system 100 increases an operational efficiency of the hydraulic fracturing system 100 and enhances worksite productivity.

By way of the above described configuration of the hydraulic fracturing system 100, both the first side inlets 176 and the second side inlets 180 may allow or ease a receipt the pressurized first fluid and pressurized second fluid from the first hydraulic fracturing pumps 112' and the second hydraulic fracturing pumps 112" into the third passage 148. During the hydraulic fracturing operation, high-pressure discharge fluid flows (e.g., the pressurized first fluid) from the hydraulic fracturing pumps 112 into the high-pressure section 132 via the first side inlets 176. This may occur in combination to the pressurized second fluid's receipt into the third passage 148 through the second side inlets 180. Effectively, the third passage 148 or the high-pressure section 132 of the manifold assembly 124 may receive both the first fluid (e.g., clean fluid) and the second fluid (e.g., slurry), respectively, from the high-pressure discharge portions 362 of the hydraulic fracturing pumps 112, e.g., from each of the first hydraulic fracturing pumps 112' and from the second hydraulic fracturing pumps 112".

In brevity, by way of fluidly coupling the high-pressure discharge portions 362 of the first hydraulic fracturing pumps 112' with the piping assemblies 254, during the hydraulic fracturing operation, high-pressure discharge fluid may flow from the first hydraulic fracturing pump 112' into the high-pressure section 132 via the first fluid lines 358, the piping assemblies 254, and the first side inlets 176. Also, by way of fluidly coupling the high-pressure discharge portions 362 of the second hydraulic fracturing pumps 112" with the second side inlets 180, during the hydraulic fracturing operation, high-pressure discharge fluid may flow from the second hydraulic fracturing pumps 112" into the high-pressure section 132 via the second side inlets 180. One or more of the above discussions associated with the piping assemblies 254 may be suitably applied to the piping assembly 554, as well, or to many such piping assemblies 554, as may be used in the hydraulic fracturing system 100. Moreover, the above described working may be achieved even by having the hydraulic fracturing pumps 112' arranged at a single side, e.g., the second side 156.

In some embodiments, the pressurized first fluid and the pressurized second fluid may be mixed with each other in the high-pressure section 132 of the manifold assembly 124 and/or at a region further downstream in an exemplary flow direction, e.g., which extends from the hydraulic fracturing pumps 112 to the high-pressure section 132 of the manifold assembly 124, to form the fracturing fluid. A continuous supply of the pressurized first fluid and the pressurized second fluid from the hydraulic fracturing pumps 112 into the high-pressure section 132 of the manifold assembly 124 may push and supply the fracturing fluid into the first well bore 104' such that the fracturing fluid may be further transmitted into the subterranean formation for performing the hydraulic fracturing operation at the various parts of the subterranean formation.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

It will be apparent to those skilled in the art that various modifications and variations can be made to the method and/or system of the present disclosure without departing from the scope of the disclosure. Other embodiments will be apparent to those skilled in the art from consideration of the specification and practice of the method and/or system disclosed herein. It is intended that the specification and examples be considered as examples only, with a true scope of the disclosure being indicated by the following claims and their equivalent.

What is claimed is:

1. A method for performing a hydraulic fracturing operation, the method comprising:

providing a manifold assembly configured to deliver a fracturing fluid into a well bore during the hydraulic fracturing operation, the manifold assembly having a low-pressure section and a high-pressure section, the high-pressure section including a plurality of first side inlets at a first side of the manifold assembly, a plurality of second side inlets at a second side of the manifold assembly, and an outlet at an end of the manifold assembly, the plurality of second side inlets facing away from the plurality of first side inlets, and the second side facing towards a plurality of hydraulic fracturing pumps;

fluidly coupling one or more piping assemblies to respective inlets of the plurality of first side inlets, each piping assembly, of the one or more piping assemblies, at least in part, extending laterally from the first side towards the second side and spanning over the high-pressure section; and fluidly coupling respective high-pressure discharge portions of one or more hydraulic fracturing pumps, of the plurality of hydraulic fracturing pumps, with the one or more piping assemblies such that, during the hydraulic fracturing operation, high-pressure discharge fluid is configured to flow from the one or more hydraulic fracturing pumps into the high-pressure section via the respective inlets of the plurality of first side inlets.

2. The method of claim 1, wherein, the one or more hydraulic fracturing pumps correspond to one or more first hydraulic fracturing pumps, the plurality of hydraulic fracturing pumps including one or more second hydraulic fracturing pumps, and fluidly coupling respective high-pressure discharge portions of the one or more second hydraulic fracturing pumps with the high-pressure section via respective inlets of the plurality of second side inlets.

3. The method of claim 2 further including:

using one or more first low-pressure fluid lines to correspondingly fluidly couple low-pressure sides of the one or more first hydraulic fracturing pumps correspondingly with first side outlets of the low-pressure section located towards the first side of the manifold assembly such that fluid is received into the one or more first hydraulic fracturing pumps through the first side outlets of the low-pressure section, and using one or more second low-pressure fluid lines to correspondingly fluidly couple low-pressure sides of the one or more second hydraulic fracturing pumps correspondingly with second side outlets of the low-pressure section located towards the second side of the manifold assembly such that fluid is received into the one or more second hydraulic fracturing pumps through the second side outlets of the low-pressure section.

4. The method of claim 1, wherein each piping assembly includes:

a plurality of pipe segments coupled together in series to define a flow path from a respective first side inlet to an opening, defined in the piping assembly, that faces away from the first side; and a mounting block assembly to support the piping assembly immovably with respect to the high-pressure section and the low-pressure section.

5. The method of claim 4, wherein fluidly coupling the one or more piping assemblies to the respective inlets includes coupling the mounting block assembly associated with each piping assembly onto a respective module of the high-pressure section that includes a corresponding first side inlet and a corresponding second side inlet, wherein the corresponding first side inlet and the corresponding second side inlet are arranged to extend co-axially with each other and linearly along a first axis that passes laterally across the high-pressure section.

6. The method of claim 5, wherein the plurality of pipe segments define a first part fluidly extending from the corresponding first side inlet and a second part fluidly extending from the first part to the opening.

7. The method of claim 6, wherein both the first part and the second part includes a straight portion.

8. The method of claim 6, wherein at least one of first part and the second part extends linearly along a second axis parallel to the first axis.

9. The method of claim 6, wherein at least one of the first part and the second part includes a curved portion.

10. A hydraulic fracturing system for stimulating one or more well bores, the hydraulic fracturing system comprising:

a manifold assembly configured to deliver a fracturing fluid into a well bore during a hydraulic fracturing operation, the manifold assembly having a low-pressure section and a high-pressure section, the high-pressure section including a plurality of first side inlets at a first side of the manifold assembly, a plurality of second side inlets at a second side of the manifold assembly, and an outlet at an end of the manifold assembly, the plurality of second side inlets facing away from the plurality of first side inlets;

a plurality of hydraulic fracturing pumps arranged towards the second side of the manifold assembly;

one or more piping assemblies fluidly coupled to respective inlets of the plurality of first side inlets, each piping assembly of the one or more piping assemblies, at least in part, extending laterally from the first side towards the second side, spanning over the low-pressure section and the high-pressure section; and one or more fluid lines to fluidly couple respective high-pressure discharge portions of one or more hydraulic fracturing pumps, of the plurality of hydraulic fracturing pumps, with the one or more piping assemblies such that, during the hydraulic fracturing operation, high-pressure discharge fluid is configured to flow from the one or more hydraulic fracturing pumps into the high-pressure section via the respective inlets of the plurality of first side inlets.

11. The hydraulic fracturing system of claim 10, wherein, the one or more hydraulic fracturing pumps correspond to one or more first hydraulic fracturing pumps, the plurality of hydraulic fracturing pumps including one or more second hydraulic fracturing pumps, and the one or more fluid lines correspond to one or more first fluid lines, the hydraulic fracturing system including:

one or more second fluid lines to fluidly couple respective high-pressure discharge portions of the one or more second hydraulic fracturing pumps with the high-pressure section via respective inlets of the plurality of second side inlets such that, during the hydraulic fracturing operation, high-pressure discharge fluid is configured to flow from the one or more second hydraulic fracturing pumps into the high-pressure section via the respective inlets of the plurality of second side inlets.

12. The hydraulic fracturing system of claim 11 further including:

one or more first low-pressure fluid lines to correspondingly fluidly couple low-pressure sides of the one or more first hydraulic fracturing pumps correspondingly with first side outlets of the low-pressure section located towards the first side of the manifold assembly such that fluid is received into the one or more first hydraulic fracturing pumps through the first side outlets of the low-pressure section, and one or more second low-pressure fluid lines to correspondingly fluidly couple low-pressure sides of the one or more second hydraulic fracturing pumps correspondingly with second side outlets of the low-pressure section located towards the second side of the manifold assembly such that fluid is received into the one or more second hydraulic fracturing pumps through the second side outlets of the low-pressure section.

13. The hydraulic fracturing system of claim 10, wherein each piping assembly includes:

plurality of pipe segments coupled together in a series to define a flow path from a respective first side inlet to an opening, defined in the piping assembly, that faces away from the first side; and a mounting block assembly to support the piping assembly immovably with respect to the high-pressure section and the low-pressure section.

14. The hydraulic fracturing system of claim 13, wherein fluidly coupling the one or more piping assemblies to the respective inlets includes coupling the mounting block assembly associated with each piping assembly onto a respective module of the high-pressure section that includes a corresponding first side inlet and a corresponding second side inlet, wherein the corresponding first side inlet and the corresponding second side inlet are arranged to extend co-axially with each other and linearly along a first axis that passes laterally across the high-pressure section.

15. The hydraulic fracturing system of claim 14, wherein the plurality of pipe segments define a first part fluidly extending from the corresponding first side inlet and a second part fluidly extending from the first part to the opening.

16. The hydraulic fracturing system of claim 15, wherein both the first part and the second part includes a straight portion.

17. The hydraulic fracturing system of claim 15, wherein at least one of first part and the second part extends linearly along a second axis parallel to the first axis.

18. The hydraulic fracturing system of claim 15, wherein at least one of the first part and the second part includes a curved portion.

19. A system to deliver a frac fluid from a low-pressure section of a manifold assembly to a high-pressure section of the manifold assembly, the system comprising:

one or more piping assemblies configured to be fluidly coupled to respective inlets of a plurality of first side inlets of the high-pressure section, the plurality of first side inlets being located at a first side of the manifold assembly, each piping assembly of the one or more piping assemblies defining an opening configured to face away from the first side, the second side being opposite to the first side, wherein each piping assembly includes:

plurality of pipe segments coupled together in a series to define a flow path from a respective first side inlet to the opening; and a mounting block assembly to support the piping assembly immovably with respect to the high-pressure section and the low-pressure section.

20. The system of claim 19, wherein each piping assembly, at least in part, extends laterally from the first side towards the second side, spanning over the high-pressure section and the low-pressure section of the manifold assembly to define the opening.

* * * * *